United States Patent [19]

Huckaby

[11] 4,166,715

[45] Sep. 4, 1979

[54] OIL WELL PUMPING TUBE DRAIN DEVICE

[76] Inventor: Leonard L. Huckaby, P.O. Box 152, Wayne, Okla. 73095

[21] Appl. No.: 885,802

[22] Filed: Mar. 13, 1978

[51] Int. Cl.[2] ..... F04B 21/00; F04B 39/00

[52] U.S. Cl. ..... 417/434; 417/443; 417/545

[58] Field of Search ..... 417/434, 554, 443

[56] References Cited

U.S. PATENT DOCUMENTS

| | | | |
|---|---|---|---|
| 2,062,058 | 11/1936 | Howe | 417/434 |
| 2,674,200 | 4/1954 | Howe | 417/434 |
| 2,949,861 | 8/1960 | Heath | 417/443 |
| 2,997,963 | 8/1961 | Hatcher | 417/434 |
| 3,150,605 | 9/1964 | Howe | 417/434 |
| 4,049,365 | 9/1977 | Sparks | 417/554 |

*Primary Examiner*—William L. Freeh
*Attorney, Agent, or Firm*—Ralph B. Pastoriza

[57] ABSTRACT

A specially designed valve is incorporated in the pumping tube of an oil well pump secured to the lower end of an oil well pipe string. In pumping the well, oil is drawn up through the pumping tube and oil pipe string to the surface. The check valve is arranged to be actuated from the surface of the well in response to lowering the sucker rods for operating the pump beyond the normal amplitude limits to thereby place into communication the oil in the pumping tube and pipe string with the annulus of the well between the well casing and exterior walls of the pumping tube pipe string thereby equalizing the hydrostatic pressure and permitting pulling of the well pipe for pump servicing or other operations.

2 Claims, 3 Drawing Figures

OIL WELL PUMPING TUBE DRAIN DEVICE

This invention relates generally to oil well tools and more particularly to an oil well pumping tube drain device for equalizing the hydrostatic pressure of oil in the well pipe string and well annulus. This operation is sometimes referred to as hydraulic unloading or "dumping".

BACKGROUND OF THE INVENTION

In order to pump oil from a well in which casing has been set, the casing is perforated by a suitable gun at those levels in which oil has been indicated to exist. After the casing has been perforated a pump is lowered on the end of the conventional drill pipe string to this particular level. The pump includes a pumping tube a portion of which is sometimes referred to as a barrel within which a reciprocating plunger operates. This plunger is driven by a polish rod extending upwardly through the pumping tube to connect to the end of sucker rods which pass up through the drill pipe string to the surface of the well. Oil is pumped from the lower annulus adjacent the perforations in the casing through the pumping tube and up through the well pipe string to the surface of the well.

After pumping has been completed, or if it is desired to change the pump or repair it, it is necessary to pull the pipe string to bring the pump to the surface. Since, however, the pumping tube as well as the pipe string is filled with oil throughout the length of the pipe string, whereas the surrounding fluid in the well annulus defined between the exterior of the pumping tube and pipe string and interior of the casing is at a relatively low level, there exists a very large pressure differential rendering it extremely difficult to pull the pipe.

The foregoing condition can be overcome if the fluid or oil within the pipe string and pumping tube could be passed in a reverse direction to the annulus exterior of the pumping tube and string. If the fluid could be passed in this manner, the large hydrostatic head created within the pipe string could be "dumped" into the surrounding annulus of the well and thus equalize the pressures involved so that removal of the pipe string without the large hydrostatic head of oil could be readily achieved.

My U.S. Pat. Nos. 3,168,873 issued Feb. 9, 1965 and 4,047,853 issued Sept. 13, 1977 disclose hydraulic unloading and circulating devices which solve the foregoing problem. However, the solutions described in these patents are not suitable for certain types of oil well pumps.

More particularly, there has been introduced an improved type of well pump capable of delivering a greater capacity of oil through a pipe string than previously available pumps. One such improved type pump is provided by the Heavy Oil Producers Service, Inc. and are referred to in the art as HOPS type pumps. Pumps of this type include a relatively large diameter pumping tube which connects to the extreme end of the drill pipe string rather than being received within the drill pipe string. For such a pump, it would be desirable to incorporate some type of hydraulic unloading or pressure equalizing means in the pumping tube itself. Further, it would be a desirable feature to be able to operate the "dumping" or equalizing device from the surface of the bore hole and so design the device that it will provide continuous communication between the interior of the pipe string and well annulus while pulling the pipe.

A further consideration with respect to the foregoing would be provision of such a hydrostatic equalizing device which could be incorporated in the newer type referred to pumps with a minimum of structural modification all to the end that overall economy is realized in the manufacture and use of the device.

BRIEF DESCRIPTION OF THE INVENTION

Bearing the foregoing in mind, the present invention contemplates an improved oil well pumping tube drain device particularly applicable to pumps of the HOPS type which can be readily installed with a minimum of modification of the pump itself and which can be operated from the surface of the well to equalize hydraulic fluid pressure on the inside and outside of the drill pipe string.

Briefly, the present invention contemplates the provision of a normally closed check valve secured to the side wall of the pumping tube making up the pump itself. This valve is arranged to place the oil passing up through the tube and pipe string into communication with the well annulus when open; that is, a passage is opened through the pumping tube wall.

Cooperating with this valve is a means responsive to movement of the polish rod operating the pump plunger beyond its normal amplitude of reciprocation in pumping the well to open the valve and thereby equalize the hydrostatic pressure.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
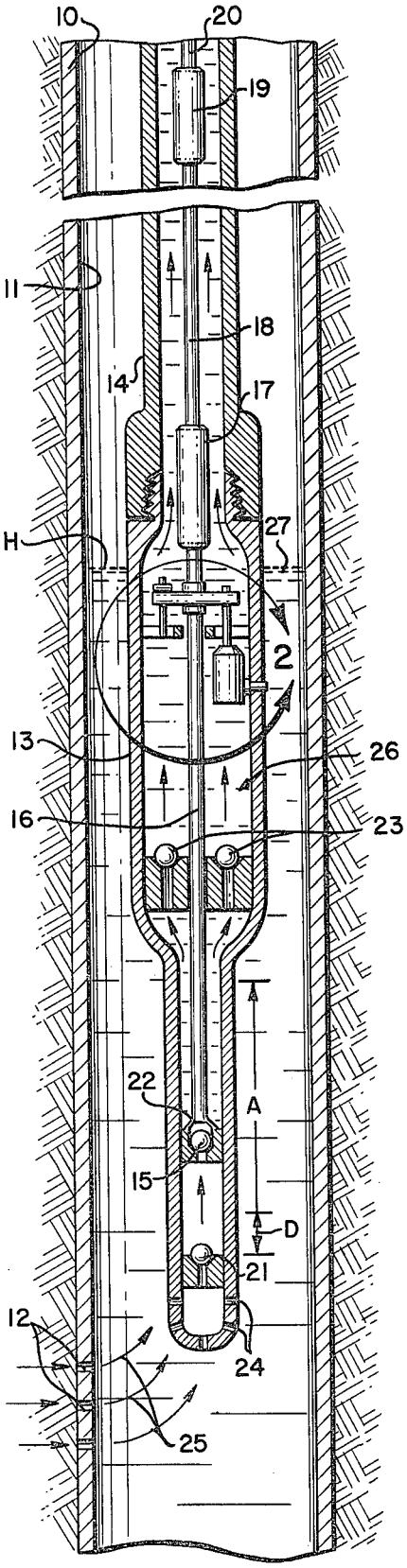
FIG. 1 is a fragmentary cross section of an oil well showing the lower end portion of a pipe string to which is secured an oil well pump incorporating the drain device of this invention.

Referring to the upper left portion of FIG. 1, there is shown an oil well 10 provided with the usual casing 11. This casing is shown in the extreme lower left portion of FIG. 1 as perforated at 12 for permitting oil to pass from the surrounding formations into the well.

A pumping tube is shown at 13 having its upper end secured to the extreme lower end of an oil well pipe string 14. This particular pumping unit includes a decreased diameter lower portion serving as a pump barrel within which a plunger 15 is arranged to be reciprocated by a polish rod 16 extending upwardly into the pumping tube 13.

The upper end of the polish rod 16 is secured by a coupler 17 to the lowermost sucker rod 18. Several such sucker rods are connected in series to extend to the top of the well which may be several hundred feet. Various "on-off" couplings are provided at periodic intervals such as indicated at 19 for a successive sucker rod 20.

Referring once again to the lower pump barrel portion of the pumping tube 13, there is shown a fixed check valve 21. The plunger 15 itself includes a check valve 22, the periphery of the plunger being in sealing relationship with the inside interior wall of the surrounding pumping tube portion. In the particular pump illustrated in FIG. 1, there are provided additional check valves 23 referred to as "standing valves" disposed in the lower larger diameter portion of the pumping tube 13. The extreme lower end of the pumping tube below the fixed lower check valve 21 is provided with suitable filtering openings 24 to permit oil from the casing perforations 12 to enter into the lower portion of the pump as indicated at 25.

With the foregoing arrangement, reciprocating up and down movement of the sucker rods by the "horsehead" assembly at the well surface will move the plunger 15 up and downwardly within the pump barrel portion of the pumping tube 13 through a given amplitude indicated by the letter A. On the down stroke, the check valve 21 is closed and the check valve 22 open to permit oil to pass to the upper side of the plunger. On the up stroke, the check valve 22 on the plunger closes and the fixed check valve 21 opens permitting oil to enter beneath the plunger. The oil above the plunger is thus lifted into the main portion of the pumping tube 13 all as indicated by the arrows.

The stroke or amplitude of the pump can be adjusted at the surface of the well by adjusting the movement of the sucker rods. Normally, the plunger 15 will not move to the extreme bottom of the pumping barrel but the lower most amplitude point terminates short by a given distance D as indicated in FIG. 1.

With continuous pumping, the entire pumping tube 13 and pipe string 14 will eventually be completely filled with oil which will then be taken from the upper exit portion of the tubing pipe string at the well surface. The weight of this column of oil is substantial and prior to attempting to pull the pipe string to repair the pump or replace it or even after completion of pumping operations, it is desirable all as described heretofore to "dump" this column of oil; that is, to equalize the hydrostatic pressure of the column of oil within the drill pipe string with the oil in the well annulus.

In FIG. 1, the oil within the pumping tube 13 and pipe string 14 is designated by the arrow 26 while the oil in the annulus defined by the interior wall of the casing 11 and the exterior wall of the pumping tube 13 and pipe string 14 is indicated at 27. This oil is at a substantially less height and may terminate at a level H quite close to the lower end of the well. For a well several hundred feet deep, the difference in hydrostatic pressure between the oil 26 and oil 27 can be appreciated.

The oil well pumping tube drain device in accord with the present invention is shown in FIG. 1 incorporated within the pumping tube 13 all enclosed within the circular arrow 2. As will become evident as the description proceeds, this device is so designed as to require a minimum modification of the pump itself so that it may be separately manufactured and readily installed in pumps of the type under consideration.

Figure 2:
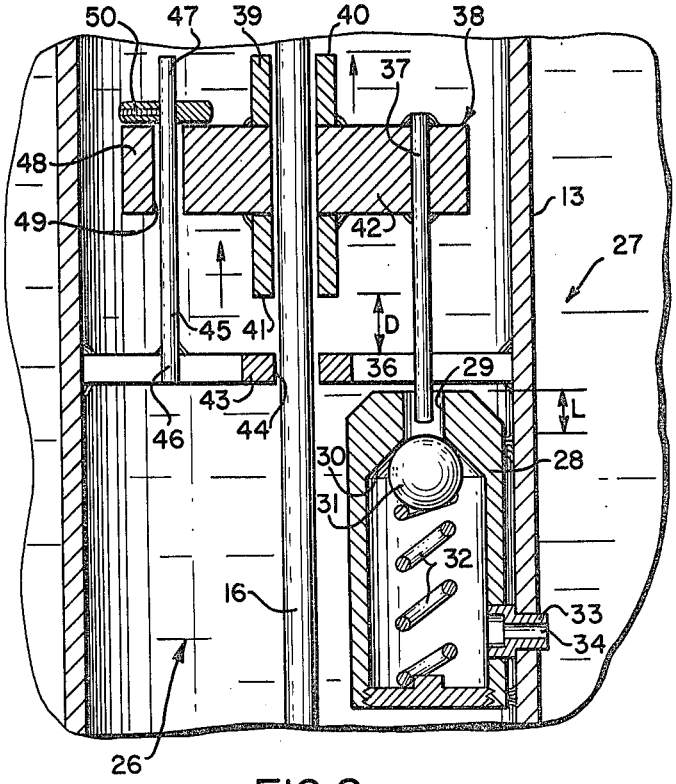
FIG. 2 is a greatly enlarged cross section of the drain device in its unactuated condition together with other portions of the pump all enclosed within the circular arrow 2 of FIG. 1; and, FIG. 3 is a view similar to FIG. 2 but illustrating the relative positions of certain components of the device when actuated to cause draining or "dumping".

Referring now to FIG. 2 there is shown the portion of the device enclosed within the circular arrow 2 of FIG. 1 in greatly enlarged view. Essentially, the device comprises a check valve housing 28 secured to the interior of the pumping tube wall 13 adjacent to a portion of the polish rod 16. This housing has a vertical open passage 29 at its upper end extending downwardly into the housing to terminate in an increased diameter portion defining a valve seat 30. A ball 31 is biased upwardly against the valve seat as by a spring 32 within the interior of the housing 28.

Referring to the lower right portion of the housing 28 there is provided a fitting 33 passing through the housing wall and extending through the side wall portion of the pumping tube 13 thereby defining an outlet orifice 34 placing the interior of the housing below the valve seat 30 in communication with the exterior of the pumping tube 13 and thereby in communication with the well annulus. The provision of a small opening in the pumping tube side wall 13 to accommodate the fitting 33 is essentially the only structural modification of the pump components that need be effected.

Cooperating with the described check valve is a valve rod 35 having one end 36 received in the upper open end of the passage 29 as shown in a position to engage the top surface of the ball 32. The other end of the valve rod 35 extends upwardly as indicated at 37. This upper end 37 is rigidly secured to an engaging means designated generally by the arrow 38. The engaging means is designed to move downwardly when engaged by any type of enlargement means secured to the polish rod 16 to thereby move the valve rod 35 downwardly and unseat the ball 31 from the valve seat 30. This action, of course, opens up communication between the oil 26 within the pumping tube 13 and pipe string with the oil 27 in the well annulus thereby providing the desired equalization of hydrostatic pressure.

In the specific embodiment illustrated in FIG. 2, the engaging means 38 takes the form of a sleeve segment 39 having upper and lower ends 40 and 41 surrounding a portion of the polish rod 16 as shown. It will be understood that the polish rod can reciprocate to operate the pump in the usual manner through the sleeve 39 without affecting the sleeve.

As shown, the sleeve itself includes an exterior laterally extending structure 42 to which the upper end 37 of the guide rod 35 is securely affixed so that up and down movement of the sleeve 39 will similarly move the valve rod 35.

Shown below the engaging means 38 is a fixed structure 43 having a central opening 44 through which the polish rod 16 passes. Fixed structure 43 includes radially extending vanes secured to the interior walls of the pumping tube 13 as shown. On the leftward extending vane of the structure 43 is a guide rod 45 having its lower end secured as at 46 to this vane to one side of the central opening 44. Rod 45 extends vertically upwardly to terminate in a free standing upper end 47. A further portion 48 of the exterior laterally extending structure 42 is provided with a vertical bore 49 positioned to receive the upwardly extending portion of the rod 47 therethrough. A stop means in the form of a nut 50 is secured at a given position on the extending portion 47 of the guide tube 45.

As indicated in FIG. 2, the positioning of the stop nut 50 on guide tube 47 is such that when the engaging means in the form of the sleeve 39 is moved upwardly against this stop, the valve rod 35 is still received in the passage 29 of the check valve housing. The stop nut 50 will thus prevent the lower end of the valve rod 35 from escaping the passage 29 in the event rapidly flowing oil or sand through and past the sleeve should tend to move it upwardly along the polish rod 16.

In FIG. 2 as well as the other drawings, the vertical dimensions have been greatly underexaggerated relative to the horizontal dimensions of the various components in order that the structure may be clearly shown in the drawings. Thus, while the length of the passage 29 in FIG. 2 which length is indicated at L appears to be relatively short, it is in reality a fairly long passage in order that there is no possibility of the valve rod 35 being moved completely out of the passage.

Figure 3:
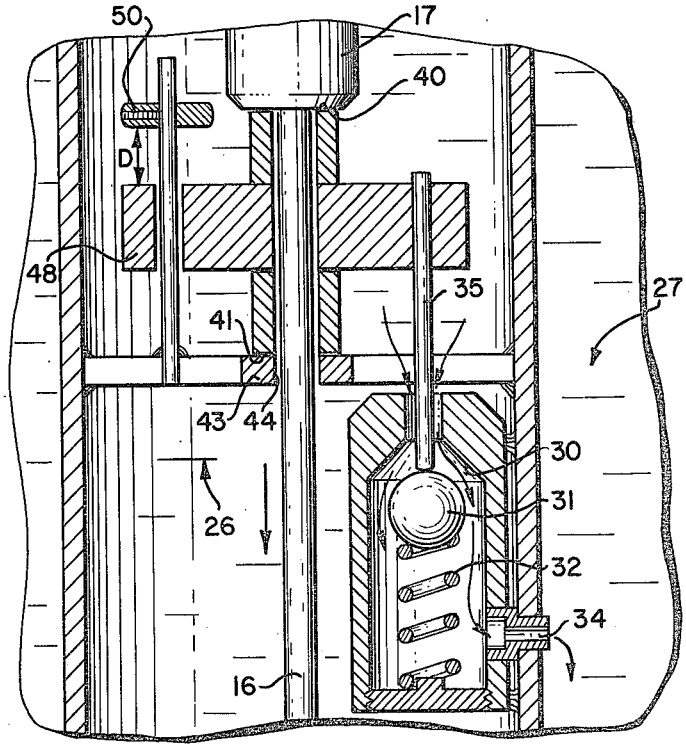

Referring now to FIG. 3, there are shown the same components described in FIG. 2 except that the polish rod 16 has been moved downwardly an additional distance D beyond its lowermost amplitude point of normal reciprocation. The positioning of the check valve housing 28, fixed structure 43 and length of the valve rod 35 is all designed such that the upper end 40 of the sleeve will be engaged by the lower end of the coupling 17 between the polish rod 16 and first sucker rod 18 described in FIG. 1. Engagement of the sleeve by this coupling which will move further downwardly when the polish rod 16 is moved downwardly the additional distance D will thus lower the valve rod 35 against the ball 31 to unseat the same. The motion of the engagement means including the sleeve structure is guided by the fixed guide tube 45 wherein it will be evident that the lateral exterior structure 48 has moved away from the stop nut 50.

The downward movement of the engaging structure by the coupling 17 is checked by engagement of the lower end 41 of the sleeve with the fixed structure 43 as illustrated in FIG. 3.

OPERATION

The operation of the pumping tube drain device will be evident from the foregoing description. As described heretofore, the only modification that need be made of the pumping tube 13 of FIG. 1 is the provision of a small opening in the lateral wall to accommodate the fitting 33 described in FIG. 2. The fixed structure 43 with radially extending vanes can then be provided in the pumping tube if such fixed structure is not already present. In many pumps there is provided a fixed vane structure to support a bushing for the polish rod 16 and in such event this structure, could of course be used. In either event, the fixed structure can readily be provided together with the guide tube 45 secured thereto. The engagement means in the form of the sleeve 39 with the valve rod 37 secured thereto at a circumferentially spaced location from the guide rod 45 can be received over the polish rod, the lower end portion of the valve rod 35 being received in the passage 29 of the housing 28. As described heretofore, some means is necessary on the polish rod which will serve to engage the upper end of the collar shown at 40 to move the engagement means downwardly when it is desired to open the valve. By properly locating the components within the pumping tube 13, this means is automatically provided by the lower end of the coupling 17 which will define a downwardly facing shoulder at its point of connection to the polish rod 16. However, it should be understood that a simple collar for this purpose could be secured at any desired position along the polish rod 16.

The strength of the spring 32 for the ball 31 is sufficient to hold the valve closed under the highest hydrostatic pressure resulting from the column of oil in the pipe string that might occur. In fact, the spring force is such that unseating of the ball can only be accomplished by exerting an additional weight or force over that of the hydrostatic pressure and as described, this additional weight is essentially provided by the weight of the sucker rods by simply permitting them to move downwardly along with the polish rod 16 past the lowest amplitude limit of normal pumping all as described.

Such additional movement will thus unseat the ball as shown in FIG. 3 when the fluid column in the pumping tube and pipe string can then flow out the pumping tube to the annulus through the orifice 34 as indicated by the various arrows.

In case of pulling the pipe string, it is desirable to hold the check valve in open position. Holding the valve open can be accomplished by unthreading one of the "on-off" couplings such as 19 shown in FIG. 1 between successive sucker rods at a point to leave for example, from ten to eleven sucker rods still attached to the polish rod. The weight of these sucker rods will hold the sleeve segment and thus the valve rod in their down position illustrated in FIG. 3 against the bias of the spring 32.

From all of the foregoing, it can be appreciated that the present invention provides a means for equalizing the hydrostatic pressure by draining the fluid or oil column in the pipe string to the annulus without having to effect any major modifications in the pumping equipment other than the provision of the drain opening in the side wall of the pumping tube. Moreover, the device does not rely on sheer pins as characterize some types of prior art "dumping" structures which then, in order to be re-used, require new sheer pins.

While the tube drain device has been described as incorporated in the upper portion of the pumping tube 13 as illustrated in FIG. 1, the check valve itself could be positioned considerably lower within the pumping tube and in fact could be substituted for one of the standing valves 23 illustrated in FIG. 1. In this event, the valve tube 35 described in FIG. 2 would be made substantially longer so as to be received in the check valve housing passage.

It should also be understood that while the valve has been referred to as a check valve, a simple plunger with O rings for uncovering an orifice could be used. The valve rod would then simply move the plunger rather than the ball as in the check valve.

Finally, while actuation of the valve has been described as being responsive to downward movement of the polish rod, it should be understood that one of the sucker rods, for example the lowermost or next to the lowermost sucker rod could be used to actuate the valve rod by providing a properly positioned enlargement or alternatively utilizing one of the couplings connecting successive sucker rods. In such event it is clear that the use of a sucker rod is equivalent to that of the polish rod.

The basic concept involved is the actuation of the valve by the weight of the sucker rods controllable from the surface of the well.

The invention as described is therefore not to be thought of as limited to the specific embodiment set forth for illustrative purposes.

I claim:

1. A drain device for insertion in an oil well pumping tube supported at the end portion of a pipe string, to equalize the hydrostatic pressure of oil pumped up through said tube and pipe string, and the oil in the annulus defined between the exterior of the pumping tube and pipe string and interior wall of the casing, and wherein a polish rod on the end of sucker rods in the pipe string for reciprocating a pump plunger in the lower portion of said pumping tube extends into said pumping tube, said device including, in combination:

(a) a check valve housing secured to the interior of said pumping tube adjacent to a portion of said polish rod, said housing having a vertical open passage at its upper end extending downwardly into the housing to terminate in an increased diameter portion defining a valve seat, a valve ball and spring biasing the ball upwardly against said valve seat to hold the check valve normally closed, the upper end of said passage in said housing above said valve seat being in communication with the oil passing up through said tube and pipe string;

(b) a fitting in the lower wall of said housing below said valve seat and extending through a side wall portion of said pumping tube, said fitting defining an outlet orifice placing the interior of said housing below said valve seat in communication with the exterior of said pumping tube and thereby in communication with said annulus;

(c) a valve rod having one end received in the upper open end of said passage in a position to engage the top surface of said ball;

(d) engageable means secured to the opposite end of said valve rod; and (e) means on said polish rod defining a downwardly facing annular shoulder positioned to engage said engageable means to move said valve rod downwardly and unseat said ball only when said polish rod is intentionally lowered beyond its normally lowest reciprocating point by lowering the sucker rods in said pipe string, whereby oil in said pipe string can flow through said check valve to said annulus to equalize said hydrostatic pressure, said engageable means including a sleeve segment having upper and lower ends surrounding a portion of said polish rod adjacent to said valve rod such that said polish rod can reciprocate through said sleeve, said sleeve having an exterior laterally extending structure, said valve rod being secured to a portion of said laterally extending structure of said sleeve; a fixed structure secured to the inside of said pumping tube a given distance below said lower end of said sleeve and having a central opening through which said polish rod passes; a guide rod having one end secured to said fixed structure to one side of said central opening and extending vertically upwardly, said exterior laterally extending structure of said sleeve including a portion circumferentially spaced from said first mentioned portion defining a vertical bore positioned to receive the upwardly extending end of said guide rod therethrough; and stop means secured to the extending end of said guide rod above said bore to function as a first stop to limit upward movement of said sleeve a given distance such that the lower end of said valve rod is still received in said passage of said check valve housing when said stop means is engaged by said laterally extending structure of said sleeve, said lower end of said sleeve engaging said fixed structure upon downward movement, said given distance being sufficient to permit unseating of said ball by said valve rod, said means on said polish rod for engaging said engageable means comprising a coupling for connecting said polish rod to the lowermost sucker rod, said coupling engaging said upper end of said sleeve when said sucker rods are lowered beyond said lowest reciprocating point.

2. A device according to claim 1, in which said spring is designed to exert a given force to hold said ball against said valve seat sufficient to prevent unseating by the normal hydrostatic head pressure of oil in said pumping tube and pipe string so that unseating can only be accomplished by exerting an additional weight of sucker rods to said valve rod through said engaging means, said additional weight being between the weight of ten to eleven sucker rods so that said check valve can be held open when pulling the pipe string from the well by uncoupling the sucker rod string at a point to leave the weight of at least ten sucker rods on the engageable means.

* * * * *